US005282954A

United States Patent [19]

Opaskar

[11] Patent Number: 5,282,954

[45] Date of Patent: Feb. 1, 1994

[54] ALKOXYLATED DIAMINE SURFACTANTS IN HIGH-SPEED TIN PLATING

[75] Inventor: Vincent C. Opaskar, Bainbridge Twp., Cuyahoga County, Ohio

[73] Assignee: Atotech USA, Inc., Somerset, N.J.

[21] Appl. No.: 815,735

[22] Filed: Dec. 30, 1991

[51] Int. Cl.[5] ..... C25D 3/32; C25D 3/60

[52] U.S. Cl. ..... 205/302; 205/252; 205/301

[58] Field of Search ..... 205/252, 301, 302, 303, 205/299

[56] References Cited

U.S. PATENT DOCUMENTS

| | | | |
|---|---|---|---|
| 4,100,040 | 7/1978 | Rosenberg | 205/314 |
| 4,139,425 | 2/1979 | Eckles | 205/299 |
| 4,662,999 | 5/1987 | Opaskar et al. | 205/299 |
| 4,885,064 | 12/1989 | Bokisa et al. | 205/299 |

*Primary Examiner*—John Niebling
*Assistant Examiner*—Brian M. Bolam
*Attorney, Agent, or Firm*—Stanley A. Marcus; Robert B. Henn

[57] ABSTRACT

Surfactants made by the successive ethoxylation and propoxylation of diamines are effective in providing a fine-grain tin coating in high-speed strip-steel plating operations under conditions of high current density. Surfactants prepared by successive propoxylation and ethoxylation are also effective.

13 Claims, No Drawings

ALKOXYLATED DIAMINE SURFACTANTS IN HIGH-SPEED TIN PLATING

BACKGROUND OF THE INVENTION

1. Field of the Invention

The present invention is in the field of tin plating. More particularly, this invention is in the field of surface-active additives for high-speed continuous tin and tin-alloy plating based on methanesulfonic acid.

2. Description of the Prior Art

High-speed electroplating equipment and processes for depositing tin and tin alloys are well-known in industry, and generally consist of processing the work to be plated through an appropriate electroplating solution in an electroplating cell. The electroplating solution is cycled from a reservoir into the electroplating cell to provide vigorous agitation, solution circulation and chemical replenishment.

The electroplating solution should possess a number of features for effective operation in this type of processing, these include: the ability to electroplate the desired deposit at high speed; production of a lustrous and fine-grained deposit, even at the high current densities which are required for high-speed plating; ability of the deposit to execute uniform fusing or melting and thereby demonstrate good solderability of the deposit; stability of the solution and its components to low pH and air which is generally introduced due to the vigorous solution movement in high-speed plating; and solution clarity, i.e., freedom from turbidity, even at temperatures above 50 degrees Centigrade (°C.).

Due to the high current densities involved and relatively low solution volumes, the temperature of the bath in high-speed electroplating methods increases until the solution reaches equilibrium at an elevated temperature with its ambient environment. Additives must not cause solution turbidity at elevated temperatures above their cloud point.

Because of vigorous solution movement and mixing with air, there is a strong tendency to produce a foam, which can be detrimental to the electroplating process. The additives used should generate as little foam as possible in the plating equipment, and preferably should generate none at all.

Many electrolytes have been proposed for electroplating tin and tin alloys; one of these is described in U.S. Pat. No. 4,701,244, to Nobel et al. This patent discloses the electroplating of tin, lead or tin/lead alloys from lower alkyl sulfonic acid baths which contain brightening additives and wetting agents of various types. Surfactants disclosed in that patent comprise betaines, alkylene oxide polymers, imidazolinium compounds, quaternary ammonium compounds, ethylene oxide derivatives of amines, phosphonates and amides.

U.S. Pat. No. 4,673,470 describes a tin, lead, or tin/-lead alloy plating bath based upon an aliphatic or aromatic sulfocarboxylic acid. Instead of the alkane or alkanol sulfonic acids disclosed in previous patents, this patent includes a carboxylic acid radical in the organic sulfonic acid compound. The electroplating baths described contain brightening agents plus a surface-active agent, also known as a surfactant, with particular emphasis on those agents which are non-ionic. A very broad group of non-ionic surface-active agents is described as being useful, and a wide range of such wetting agents is listed.

In all of the prior-art baths which have been proposed, the wetting agents described as being useful for producing either bright or matte deposits are very broadly described, and are deemed somewhat equivalent to one another. Numerous examples are given in each of the referenced patents, directed to a wide variety of agents of many different types, most of which contain some type of ether or similar condensation compound.

Most of the prior-art surface-active agents are unsuitable for high-speed plating in modern high-speed plating equipment. These agents are generally incapable of satisfying all of the requirements for the electrolytes listed above.

Tin plating is a well-known method of protecting steel from corrosive attack in containers for packaging food, especially those of a relatively corrosive medium such as, e.g., tomato products, processed pineapple, cherries, and the like. Because of the very high volume of products packaged in tin-plated steel cans, the amount of tinned steel is correspondingly large, and the tinning process, to be economical and effective, must be rapid and thorough. While processes to deposit tin on a steel surface are known, there are a number of problems to which attention must be given. The tin deposit must cover the steel surface thoroughly, and with a minimal porosity through which attack on the steel surface can occur. The problem of corrosive attack on the steel can be partially met by increasing the thickness of the coverage, but this approach is too costly.

Those skilled in the art are aware that there are a number of properties which an electroplating solution for steel should possess to permit reliable, economical high-speed plating. As noted, these properties include clarity, or freedom from turbidity; stability to air and strong acid; a minimal or zero tendency to produce foam; and the ability to provide a lustrous, fine-grained deposit, even under plating conditions involving high current densities. Further, the tin coating in its final state on the steel should have a good ability to be remelted and soldered.

In my U.S. Pat. No. 4,662,999, I describe a bath for the electrodeposition of tin and tin-containing alloys. That bath is free of fluoride and fluoborate ion, and contains alkylsulfonic acids and non-ionic, cationic, anionic and amphoteric surfactants and brightening agents. Other United States patents in this field include Nobel et al., U.S. Pat. No. 4,717,460; Toben et al., U.S. Pat. No. 4,880,507; and Kroll et al., U.S. Pat. No. 4,923,576.

Johnson, in U.S. Pat. No. 3,860,502, discusses ethoxylated naphthol as a surfactant in the high-speed tin plating of strip steel. He notes that while relatively short molecules provide little foaming but somewhat poor solubility, improving solubility by simply increasing the degree of ethoxylation, i.e., the amount of ethylene oxide added per molecule of naphthol, leads to excessive foaming and a requirement for very high current densities. He therefore sulfonates the molecule and limits the degree of ethoxylation to the range of about five to seven.

SUMMARY OF THE INVENTION

The present invention comprises the use of ethoxylated and propoxylated diamines as surfactants in a methanesulfonic-acid-based bath for the high-speed plating of strip steel at high current densities.

DESCRIPTION OF THE PREFERRED EMBODIMENTS

The preferred embodiment of this invention comprises the use of alkoxylated diamines as surfactants in an alkylsulfonic-acid based bath for the high-speed tin and tin-alloy plating of strip steel. The desired group of surfactants has a diamine portion and an multi-alkoxylated portion, and consists of ethoxylated or propoxylated diamines, or both. More preferred is the use of ethoxylated and propoxylated diamines as surfactants in a methanesulfonic-acid-based bath for the high-speed plating of strip steel at high current densities. The most-preferred embodiment of this invention comprises the use of two- to eighteen-carbon aliphatic and mixed aromatic and aliphatic ethoxylated diamines, wherein the diamine molecule is successively alkoxylated with either ethylene oxide or propylene oxide, or both, in either order.

The present invention provides non-ionic surface-active agents which are useful in high-speed electroplating, particularly in the tin plating of strip steel at high linear speeds and high current densities.

This invention is useful for the fine-grain deposition of tin on steel or other metallic substrates at high current densities. It has been determined that the composition of the bath enables plating to be carried out at speeds at least as high as those of the prior art.

The utility of the present invention offers a number of desirable features in high-speed plating of tin and tin alloys. The use of the surfactants of this invention permits a broad range of current densities in the operation of a high-speed electroplating cell, down to a minimum of about 2.7 amperes per square decimeter ($A/dm^2$). Under such conditions of low current density, it is possible to effect minor repairs to the electroplating cell or associated machinery without the necessity of stopping the machinery.

Further to the foregoing, the plating cell can be operated in the relatively wide temperature range of from about 20° to about 55° C. This permits the plating operation to be started without either pre-heating, or with the application of external heat during plating.

Due to the low foaming characteristics of the electroplating bath formulated with the surfactants of the present invention, it is unnecessary to add defoamers, typically silicones, and thus to avoid undesirable characteristics associated with them.

In addition to low foaming properties, the surfactants of this invention do not cloud the electroplating solution, and continuously provide a good grain structure at all temperatures of operation. Bath formulations using the surfactants of the present invention further avoid the use of phenol sulfonic acids and fluorine-containing additives, and thus are significantly less likely to afford damage to the environment.

In a specific example of the utility of the surfactants of the present invention, a high-speed strip-steel tin-plating operation consists of 15 grams per liter (g/l) of tin as tin methane sulfonate, and 30 g/l of free methane sulfonic acid. The surfactant of the present invention consists of ethylene diamine previously ethoxylated with about 28 moles of ethylene oxide and about 25 moles of propylene oxide; the surfactant is present in the bath at a concentration of 0.02 g/l of bath volume.

Another embodiment of the present invention comprises ethylene diamine ethoxylated with 15 to 35 moles of ethylene oxide and propoxylated with from about 15 to about 35 moles of propylene oxide. Alternatively, a mole of ethylene diamine is first propoxylated with 15 to 35 moles of propylene oxide and then ethoxylated with from about 60 to about 80 moles of ethylene oxide. The surfactants prepared as noted here have from about 40 to about 250 carbon atoms in the alkoxylated portion of the molecule.

The end-capped materials which terminate in propylene oxide moieties are favored because of their lower foaming characteristics.

The current density in the tin-plating cells was tested at from about 5 to about 55 $A/dm^2$. Foaming in the bath was negligible. The resultant tin plate had a very fine grain structure, very minimal edge roughness and excellent remelt capability.

Similar runs with metal concentrations from 10 to 40 g/l, acid concentrations from 10 to 100 g/l, and surfactant concentrations from 0.005 to 5.0 g/l and current density comparable to the previously noted examples gave plating results ranging from good to excellent.

In the course of investigating the surfactants of this invention, it has been determined that a surface-active agent with from 2 to about 26 carbon atoms in the diamine portion of the molecule along with about 40 to about 250 carbon atoms in the alkoxylated portion of the molecule provides an additive with acceptable characteristics.

It has further been found that alkoxylation with either ethylene oxide followed by propylene oxide, or the reverse order, gives a good surfactant, insofar as non-foaming, clarity and grain structure of the plate are concerned. Surprisingly, however, addition of ethylene oxide followed by propoxylation yields a superior agent insofar as foaming characteristics are concerned.

Modifications and improvements to the preferred forms of the invention disclosed and described herein may occur to those skilled in the art who come to understand the principles hereof. Accordingly, the scope of the patent to be issued hereon should not be limited solely to the embodiments of the invention set forth herein, but rather should be limited only by the advance by which the invention has promoted the art.

What is claimed is:

1. In the method for continuous electrodeposition of a tin coating on a basis metal in an electroplating cell from a solution containing tin methane sulfonate and free methane sulfonic acid under conditions of high current density and high strip speed, the improvement which consists of an alkoxylated diamine non-ionic surfactant.

2. The method of claim 1 wherein the basis metal is steel.

3. The method of claim 1 wherein the alkoxylated diamine is chosen from the group consisting of ethoxylated and propoxylated diamines, and propoxylated and ethoxylated diamines.

4. The method of claim 1 wherein the surfactant is chosen from the group consisting of alkoxylated aliphatic, aromatic and mixed aliphatic and aromatic diamines.

5. The method of claim 4 wherein the surfactant is chosen from the group consisting of ethoxylated and propoxylated aliphatic, aromatic and mixed aliphatic and aromatic diamines.

6. The method of claim 1 wherein the surfactant has from 2 to about 26 carbon atoms in the diamine portion of the molecule.

7. The method of claim 1 wherein the surfactant has from about 40 to about 250 carbon atoms in the alkoxylated portion of the molecule.

8. The method of claim 1 wherein the surfactant is ethylene diamine ethoxylated with about 20 moles of ethylene oxide and thereafter propoxylated with about 30 moles of propylene oxide.

9. In a tin methane sulfonate and sulfonic acid-based bath for tin-plating steel at high speed and a current density of from about 5 to about 55 $A/dm^2$, the improvement which consists of an alkoxylated diamine non-ionic surfactant.

10. The bath of claim 9 wherein the diamine is ethylene diamine.

11. The bath of claim 9 wherein the surfactant has from 2 to about 26 carbon atoms in the diamine portion of the molecule.

12. The bath of claim 9 wherein the surfactant has from about 40 to about 250 carbon atoms in the alkoxylated portion of the molecule.

13. The bath of claim 9 wherein the surfactant is ethylene diamine ethoxylated with about 40 moles of ethylene oxide and thereafter propoxylated with about 30 moles of propylene oxide.

* * * * *